US010945468B1

(12) United States Patent
Hamilton

(10) Patent No.: US 10,945,468 B1
(45) Date of Patent: Mar. 16, 2021

(54) TROUSER ASSEMBLIES WITH ZIPPERS

(71) Applicant: Deborah Hamilton, Fresno, TX (US)

(72) Inventor: Deborah Hamilton, Fresno, TX (US)

( * ) Notice: Subject to any disclaimer, the term of this patent is extended or adjusted under 35 U.S.C. 154(b) by 0 days.

(21) Appl. No.: 16/858,393

(22) Filed: Apr. 24, 2020

Related U.S. Application Data

(60) Provisional application No. 63/007,126, filed on Apr. 8, 2020.

(51) Int. Cl.

| | |
|---|---|
| ***A41D 1/06*** | (2006.01) |
| ***A44B 19/26*** | (2006.01) |
| ***A41B 9/08*** | (2006.01) |
| ***A41B 9/00*** | (2006.01) |
| ***A41B 9/14*** | (2006.01) |

(52) U.S. Cl.
CPC ..... *A41D 1/06* (2013.01); *A41B 9/007* (2013.01); *A41B 9/08* (2013.01); *A41B 9/14* (2013.01); *A41D 1/065* (2013.01); *A44B 19/267* (2013.01); *A41B 2400/44* (2013.01)

(58) Field of Classification Search
CPC .. A41D 1/06; A41D 1/065; A41B 9/08; A41B 9/007; A41B 9/14; A41B 2400/44; A44B 19/267
See application file for complete search history.

(56) References Cited

U.S. PATENT DOCUMENTS 602,188 A * 4/1898 Sittig ..... A41D 1/088 2/238
2,034,312 A * 3/1936 Rubin ..... A41D 1/06 2/228
2,397,641 A * 4/1946 Blair ..... A41C 1/00 450/102
2,599,769 A * 6/1952 Macrae ..... A41D 1/089 2/228
2,789,290 A * 4/1957 Mayer ..... A41B 9/12 2/77
3,279,469 A * 10/1966 Schustack ..... A41C 1/003 450/113
4,280,230 A * 7/1981 LaFleur ..... A61F 13/72 2/406
4,554,684 A * 11/1985 Cadoret ..... A41B 11/143 2/227
4,604,761 A * 8/1986 Wright ..... A41D 1/06 2/227

(Continued)

*Primary Examiner* — Khaled Annis
(74) *Attorney, Agent, or Firm* — Elliott Law PLLC; Douglas H. Elliott; Nathan Q. Huynh

(57) ABSTRACT

Disclosed herein are trouser assemblies including a trouser assembly that may include: a trouser that may include: a trouser waistband having an internal waistband surface; a right leg portion coupled to the trouser waistband and having a right leg internal surface; a left leg portion coupled to the trouser waistband and the right leg portion and having a left leg internal surface; a rear trouser button coupled to the left leg portion, the right leg portion, or the trouser waistband, wherein the rear trouser button may be configured for removable coupling to a rear portion of underpants; and a front trouser button coupled to the left leg internal surface, the right leg internal surface, or the internal waistband surface, wherein the front trouser button may be configured for removable coupling to a front portion of the underpants.

20 Claims, 7 Drawing Sheets

(56) References Cited

U.S. PATENT DOCUMENTS 4,961,234 A * 10/1990 Leibman ..... A41D 1/06 2/234
5,010,595 A * 4/1991 Stradley ..... A41D 1/06 2/227
6,108,823 A * 8/2000 Danes ..... A61F 13/66 2/400
6,161,223 A * 12/2000 Andrews ..... A41D 1/065 2/227
6,243,878 B1 * 6/2001 Khemka ..... A41D 1/065 2/227
6,665,882 B1 * 12/2003 Pedrick ..... A41D 7/005 2/228
6,941,584 B1 * 9/2005 Matthews ..... A41D 13/02 2/227
8,091,146 B1 * 1/2012 Anhalt ..... A41D 1/08 2/227
8,108,947 B2 * 2/2012 Beauvais ..... A41B 9/08 2/78.2
8,332,966 B1 12/2012 Countryman
8,881,314 B2 11/2014 McCombs
2004/0210990 A1 * 10/2004 Stevenson ..... A41B 9/04 2/406
2006/0174399 A1 * 8/2006 Nikolayev ..... A41D 15/00 2/227
2006/0277649 A1 * 12/2006 Smith ..... A41B 11/006 2/69
2011/0167537 A1 * 7/2011 Christoff ..... A41D 1/065 2/228
2012/0167271 A1 7/2012 Swafford
2013/0263353 A1 * 10/2013 McCombs ..... A41D 1/065 2/79
2015/0101105 A1 * 4/2015 Malan ..... A41D 1/065 2/227
2015/0135407 A1 * 5/2015 Krishnan ..... A41F 9/00 2/234
2016/0015093 A1 * 1/2016 Hochman ..... A41D 1/06 2/234
2016/0219945 A1 8/2016 Chen
2016/0302497 A1 10/2016 Wu
2017/0006925 A1 * 1/2017 Priest ..... A41C 1/06
2018/0228665 A1 * 8/2018 Relekar ..... A61F 13/5611
2018/0295900 A1 * 10/2018 Murphy ..... A41D 15/002
2019/0037933 A1 * 2/2019 Mercer ..... A41D 1/065
2019/0216148 A1 * 7/2019 Miller ..... A41D 1/06
2019/0274374 A1 * 9/2019 Marconi ..... A41D 1/22

* cited by examiner

TROUSER ASSEMBLIES WITH ZIPPERS

CROSS REFERENCE TO RELATED APPLICATIONS

This application claims benefit to U.S. Provisional Application No. 63/007,126, filed on Apr. 8, 2020; and this application hereby incorporates herein U.S. Provisional Application No. 63/007,126 as if set forth herein in its entirety.

BACKGROUND

1. Field of Inventions

The field of this application and any resulting patent is trouser assemblies with zippers.

2. Description of Related Art

Various trouser assemblies with zippers have been proposed including some of the prior art references listed on the cover of the patent. However, those trouser assemblies lack the combination of features of the trouser assemblies disclosed herein. Furthermore, it is contemplated that the trouser assemblies disclosed herein may solve certain problems that prior art trouser assemblies have failed to solve. Also, it is contemplated that the trouser assemblies disclosed herein have benefits that would be surprising and unexpected to a hypothetical person of ordinary skill with knowledge of the prior art existing as of the filing date of this application. A need therefore exists for improved trouser assemblies.

SUMMARY

Disclosed herein are trouser assemblies including a trouser assembly that may include: a trouser waistband that may have a front portion with a lower edge and a rear portion with a lower edge and further having an internal waistband surface; a right leg portion coupled to the trouser waistband and having a right leg internal surface; a left leg portion coupled to the trouser waistband and the right leg portion and having a left leg internal surface; a right zipper tape coupled to the right leg portion, wherein the right zipper tape may extend from the lower edge of the front portion of the trouser waistband to the lower edge of the rear portion of the trouser waistband; a left zipper tape coupled to the left leg portion and removably coupled to the right zipper tape, wherein the left zipper tape may extend from the lower edge of the front portion of the trouser waistband to the lower edge of the rear portion of the trouser waistband; a rear trouser button coupled to the left leg internal surface, the right leg internal surface, or the internal waistband surface, wherein the rear trouser button may be configured for removable coupling to a rear portion of underpants; and a front trouser button coupled to the left leg internal surface, the right leg internal surface, or the internal waistband surface, wherein the front trouser button may be configured for removable coupling to a front portion of the underpants.

Also, disclosed herein are trouser assemblies including a trouser assembly that may include: a trouser that may include: a trouser waistband having an internal waistband surface; a right leg portion coupled to the trouser waistband and having a right leg internal surface; a left leg portion coupled to the trouser waistband and the right leg portion and having a left leg internal surface; a rear trouser button coupled to the left leg portion, the right leg portion, or the trouser waistband, wherein the rear trouser button may be configured for removable coupling to a rear portion of underpants; and a front trouser button coupled to the left leg internal surface, the right leg internal surface, or the internal waistband surface, wherein the front trouser button may be configured for removable coupling to a front portion of the underpants.

Additionally, disclosed herein are trouser assemblies including a trouser assembly that may include: a trouser that may include: a trouser waistband that may have: an internal waistband surface; and an external waistband surface; a right leg portion coupled to the trouser waistband, the right leg portion may have: a right leg internal surface; and a right leg external surface; a left leg portion coupled to the trouser waistband and right leg portion, the left leg portion having: a left leg internal surface; and a left leg external surface; a rear external trouser button coupled to the left leg external surface, the right leg external surface, or the external waistband surface, wherein the rear external trouser button may be configured for removable coupling to a front portion of underpants; and a front trouser button coupled to the left leg internal surface, the right leg internal surface, or the internal waistband surface, wherein the front trouser button may be configured for removable coupling to the front portion of the underpants.

Further, disclosed herein are trouser assemblies including a trouser assembly that may include: a trouser that may include: a circumferential waistband having an upper edge, a lower edge, a rear portion, and a front portion that may include a first end section that may include an outer surface having an outwardly facing female clasp portion and a second end section that may include a waistband flap with an inner surface having an inwardly facing male clasp portion, wherein the male clasp portion may be configured to be inserted into the female clasp portion in order to secure the waistband in a closed position; a first trouser leg with a first zipper tape extending from a first location at the lower edge of the front portion of the waistband to a second location at the lower edge of the rear portion of the waistband; a second trouser leg with a second zipper tape extending from the first location to the second location, wherein the first and second zipper tapes may be capable of being zipped from an open position to a closed position and from a closed position to an open position; and a zipper pull that may be capable of: (a) a first configuration in which the first zipper tape would be coupled to the second zipper tape when the zipper pull is in the first location at the lower end of the front portion of the waistband such that the zipper would be in a closed position; and (b) a second configuration in which the first zipper tape would be uncoupled from the second zipper tape when the zipper pull is in the second location at the lower end of the rear portion of the waistband such that the zipper would be in an open position.

Disclosed herein are trouser assemblies including a trouser assembly that may include underpants for coupling to a trouser having a crotch opening extending from a front side of the trouser to a rear side of the trouser, the underpants may include: an underpants waistband capable of being coupled to the trouser; and an underpants flap extending from a first portion of the underpants waistband, the a underpants flap may have a flap end removably coupled to a second portion of the underpants waistband, wherein the flap end may be capable of extending through the crotch opening and may be capable of being coupled to the rear side of the trouser while a person is wearing the trouser and the underpants.

Disclosed herein are trouser assemblies including a trouser assembly that may include: a trouser having a crotch opening extending from a front side to a rear side of the trouser; and underpants that may have: an underpants waistband capable of being coupled to the trouser; and an underpants flap capable of extending through the crotch opening and capable of being removably coupled to the rear side of the trouser while a person is wearing the trouser and the underpants.

Disclosed herein are trouser assemblies including a trouser assembly that may include: a trouser waistband; a right leg portion coupled to the trouser waistband; a left leg portion coupled to the trouser waistband; a trouser button coupled to an inner surface of the left leg portion, the right leg portion, or the trouser waistband; and an underpants capable of being coupled to the button, the underpants may have: an underpants waistband; and an underpants flap capable of extending between and towards a rear outer surface of either the left leg portion or the right leg portion, or both, while a person is wearing the trouser and the underpants.

Disclosed herein are trouser assemblies including a trouser assembly that may include: a trouser waistband; a right leg portion coupled to the trouser waistband; a right zipper tape coupled to the right leg portion; a left leg portion coupled to the waistband; a left zipper tape coupled to the left leg portion, wherein the left zipper tape may be capable of being removably coupled to the right zipper tape; a trouser button coupled to an inner surface of the left leg portion, the right leg portion, or the trouser waistband; and underpants that may have: an aperture receiving the trouser button therethrough; and an underpants flap capable of being disposed between the right zipper tape and the left zipper tape and coupled to an outer surface of the right leg portion, left leg portion, or the trouser waistband while a person is wearing the trouser and the underpants.

DETAILED DESCRIPTION

1. Introduction

Figure 1:
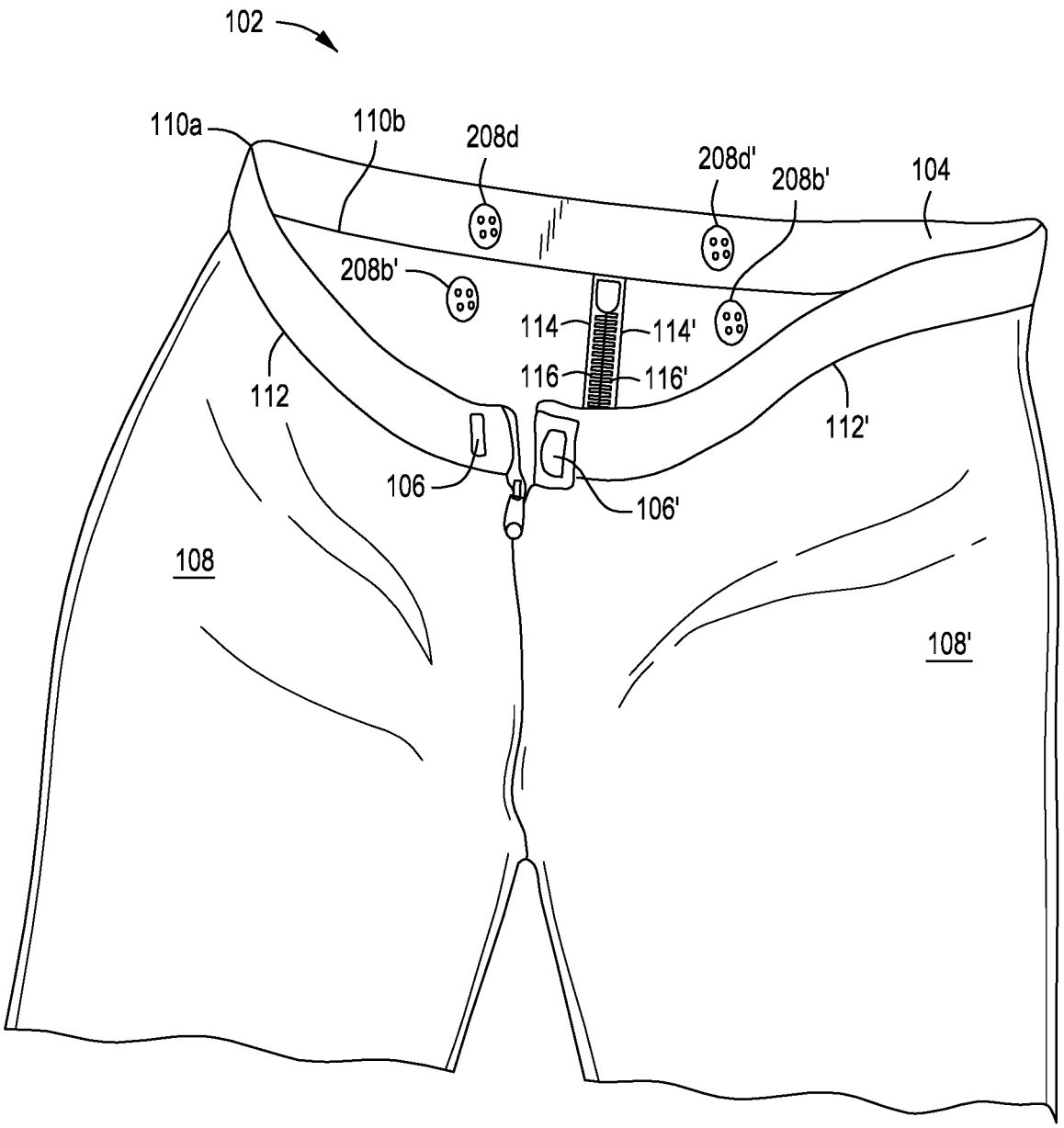
FIG. 1 illustrates a perspective front view of a trouser in an unclasped configuration with a fully closed zipper.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a surface of a flap may be abutted against a surface of a trouser.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or surface including a structure such as trouser and/or underpants. For example, an aperture may be a three-dimensional opening that begins on one side of a solid object and ends on the other side of the object, e.g., the space inside a trouser, or an aperture passing through a trouser wall. An aperture may alternatively be an opening that does not pass entirely through an object, but only partially passes through, e.g., a groove. An aperture can be an opening in an object that is completely circumscribed, defined, or delimited by the object itself. Alternatively, an aperture can be an opening formed when one object is combined with one or more other objects or structures. An aperture may receive an object, e.g., coupling means such as button(s), zipper tape, pin(s), thread(s), tape, latch(es), hook (s), fastener(s), lock(s), male and/or female connector(s) (e.g., snap buttons and stud and socket buttons), clip(s), clamp(s), clasp(s), and/or knot(s).

The term "assembly" as used herein is defined as any set of components or structures that have been fully or partially assembled together. A group of structures or assemblies may be coupled to form a larger assembly. For example, a trouser assembly may include not only a trouser, but also a zipper assembly.

The term "coupled" as used herein is defined as directly or indirectly connected or attached. A first object may be coupled to a second object such that the first object is positioned at a specific location and orientation with respect to the second object. For example, underpants may be coupled to a trouser, and a zipper assembly may be coupled to a trouser. A first object may be either permanently or removably coupled to a second object. Two objects are "permanently coupled" if once they are coupled, the two objects, in some cases, cannot be separated. Two objects may be "removably coupled" to each other, e.g., via zipper tapes, coupling means, stitching, threads, pins, clasps, tape, latches, hooks, fasteners, locks, male and female connectors, clips, clamps, knots, and/or surface-to-surface contact. For example, a flap and a trouser may be removably coupled to each other such that the flap may then be uncoupled and removed from the trouser.

The term "coupling means" as used herein is defined as any structure or combination of structures disclosed herein, including any disclosed assembly, that is capable of performing the function of coupling structures or objects together, either by itself or in combination with another structure, including cloth structures made from natural materials such as cotton, linen, etc., and also artificial materials such as polypropylene. A coupling means may be or include a button, magnet, zipper tape, pin, thread, tape, latch, hook, fastener, lock, male and female connectors (e.g., stud and socket connectors), clip, clamp, clasp, and/or knot. A coupling means may be a button sewn onto a first structure, which button may be extended through an aperture of a second apparel structure. Examples of cloth structures include structures made of natural textiles such as fabric, cotton, and linen, and also include those made from artificial materials such as polypropylene, plastics, polyester, Kevlar, and leather. A coupling means may be, for example, a first snap button and second snap button sewn onto the surfaces of particular apparel structures in which the first snap button may have a stud and the second snap button may have a socket for receiving the stud. The stud may be abutted against a surface of the second snap button. Another coupling means may be a hook and a pin sewn onto respective apparel structures, in which the hook may be coupled to the pin. A coupling means may be a first magnet and second magnet sewn onto respective apparel structures, in which the first magnet and the second magnet may be disposed adjacent to one another and may be attracted to each other. Magnets may be sewn onto inner surfaces or outer surfaces of apparel structures. Magnet may be embedded in apparel structures.

The terms "first", "second," "front," and "rear" as used herein merely differentiate two or more things or actions, and do not signify anything else, including order of importance, sequence, etc.

The term "flap" as used herein is defined as a flexible structure that has at least one long side and at least one short side, as exemplified in some of the drawings. In certain embodiments, one type of flap can be part of the trousers, in which a flap is preferably part of the waistband, e.g., a part that extends past the opening in the front of the trouser and overlaps another part of the waistband and may include a male portion of a clasp. Another type of flap can be part of the underpants and can extend from a waistband of underpants. A flap may comprise cloth and can be constructed from any one of various textiles or other fabrics or apparel materials, e.g., cotton, linen, plastic, polyester, Kevlar, and/or leather. A flap may be folded into two or more adjacent portions or segments. A flap may have a portion coupled to a front and/or a rear of a trouser. A flap may have a portion coupled to a front and/or a rear of a waistband of underpants.

The term "providing" as used herein is defined as making available, furnishing, supplying, equipping, or causing to be placed in position.

The term "surface" as used herein is defined as any face and/or boundary of a structure. A surface may also refer to that flat or substantially flat area that is extended across a flat structure which may, for example, be part of a trouser and underpants. A surface may also refer to any curved area that extends circumferentially around a cylindrical structure or object which may, for example, be part of a trouser leg. A surface may have irregular contours. A surface may be formed from coupled components, e.g., trouser legs, zipper tapes, underpants, buttons, and/or magnets. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal.

The term "trouser" as used herein is defined as any garment capable of covering a lower portion of a human body from the waist towards all or part of the legs, having two cylindrical parts, one for each leg. A trouser may comprise, e.g., be constructed from, any one of various types of cloth or other apparel material described herein, including natural textiles, e.g., fabric, cotton, or linen, or artificial materials such as plastic, polyester, Kevlar, and/or leather. A trouser may have a trouser waistband. A trouser may have a trouser waistband that is capable of being coupled to an underpants waistband. Each trouser leg as well as the overall trouser including the waistband has an internal surface and an external surface. Although the term "trouser" (singular) is used herein, a synonymous term often used elsewhere is "trousers" (plural) and as used herein they have the same meaning.

The term "unitary" as used herein defined as having the form of a single unit.

The term "underpants" as used herein is defined as any undergarment capable of covering a lower portion of a human body, e.g., the pubic region and/or the crotch, having two holes for the legs to extend through. Some underpants (e.g., "boxers") also qualify as trouser(s), since they have leg portions that extend down to cover parts of each human leg.

Underpants may have a waistband and a flap. Underpants may have a flap extending from a waistband. Underpants may have a flap having a first end extending from a rear portion of a waistband and a second end removably coupled to a front portion of the waistband. may be constructed from any one of various textiles, e.g., fabric, cotton, linen, plastic, polyester, Kevlar, and/or leather. Underpants may have an underpants waistband coupled, e.g., via buttons, to rear portions of a trouser. Underpants may have an underpants waistband coupled, e.g., via buttons, to a trouser waistband. A portion of an underpants waistband to be worn adjacent a rear portion of a trouser is said to be the rear portion of the underpants. A portion of an underpants waistband to be worn adjacent a front portion of a trouser is said to be the front portion of the underpants. Additionally, the front portion of the underpants may include a flap that removably coupled to the front portion of the underpants waistband.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" or "top" identifies any object or part of a particular object that is farther away from the center of the earth than some other object or part of that particular object, when the objects are positioned in their intended useful positions. The term "lower" or "bottom" identifies any object or part of a particular object that is closer to the center of the earth than some other object or part of that particular object, when the objects are positioned in their intended useful positions.

The term "waistband" as used herein is defined as a flexible structure that has a long side and at least one short side and forms a loop, or is capable of forming a loop, around a human torso. A waistband may have an inner surface that is configured to abut against the wearer's waist, and may thus be circumferential when the trouser of which it is a part is worn by the wearer. A waistband may be rectangular in cross-section, as illustrated in some of the drawings. A waistband may be continuous, or it may have two ends, and belt loops in the trousers may be disposed in the trousers and directed transversely to the lengthwise direction of the waistband. A waistband preferably comprises the same material as the rest of the trouser and, accordingly, may comprise cloth and be constructed from any one of various textiles, e.g., fabric, cotton, linen, plastic, polyester, Kevlar, and/or leather. A waistband may be folded into two or more adjacent portions or segments. Certain waistbands disclosed herein may have segments folded into plies that are sutured together. A waistband may have a flap extending therefrom.

The term "zipper tape" as used herein defined as a structure having teeth capable of meshing with teeth of another zipper tape. A zipper tape may be coupled to one or more edges of a trouser leg. A zipper tape may be coupled to one or more edges of a waistband. A first zipper tape may include teeth, a slider, and a box. A second zipper tape may include teeth and a pin. A first zipper tape and a second zipper tape configured for removable coupling may be parts of a zipper assembly. When used herein as a noun, the term "zipper" means two zipper tapes with teeth that are capable of meshing together. When used as a noun, the term "zipper" means to move the zipper so that the teeth of the zipper tapes are either meshing or un-meshing. The term "zippered" means the teeth of the zipper tapes are fully meshed, and the zipper is considered closed.

3. Certain Specific Embodiments

Disclosed herein are trouser assemblies including a trouser assembly that may include: a trouser waistband that may have a front portion with a lower edge and a rear portion with a lower edge and further having an internal waistband surface; a right leg portion coupled to the trouser waistband and having a right leg internal surface; a left leg portion coupled to the trouser waistband and the right leg portion and having a left leg internal surface; a right zipper tape coupled to the right leg portion, wherein the right zipper tape may extend from the lower edge of the front portion of the trouser waistband to the lower edge of the rear portion of the trouser waistband; a left zipper tape coupled to the left leg portion and removably coupled to the right zipper tape, wherein the left zipper tape may extend from the lower edge of the front portion of the trouser waistband to the lower edge of the rear portion of the trouser waistband; a rear trouser button coupled to the left leg internal surface, the right leg internal surface, or the internal waistband surface, wherein the rear trouser button may be configured for removable coupling to a rear portion of underpants; and a front trouser button coupled to the left leg internal surface, the right leg internal surface, or the internal waistband surface, wherein the front trouser button may be configured for removable coupling to a front portion of the underpants.

Also, disclosed herein are trouser assemblies including a trouser assembly that may include: a trouser that may include: a trouser waistband having an internal waistband surface; a right leg portion coupled to the trouser waistband and having a right leg internal surface; a left leg portion coupled to the trouser waistband and the right leg portion and having a left leg internal surface; a rear trouser button coupled to the left leg portion, the right leg portion, or the trouser waistband, wherein the rear trouser button may be configured for removable coupling to a rear portion of underpants; and a front trouser button coupled to the left leg internal surface, the right leg internal surface, or the internal waistband surface, wherein the front trouser button may be configured for removable coupling to a front portion of the underpants.

Additionally, disclosed herein are trouser assemblies including a trouser assembly that may include: a trouser that may include: a trouser waistband that may have: an internal waistband surface; and an external waistband surface; a right leg portion coupled to the trouser waistband, the right leg portion may have: a right leg internal surface; and a right leg external surface; a left leg portion coupled to the trouser waistband and right leg portion, the left leg portion having: a left leg internal surface; and a left leg external surface; a rear external trouser button coupled to the left leg external surface, the right leg external surface, or the external waistband surface, wherein the rear external trouser button may be configured for removable coupling to a front portion of underpants; and a front trouser button coupled to the left leg internal surface, the right leg internal surface, or the internal waistband surface, wherein the front trouser button may be configured for removable coupling to the front portion of the underpants.

Further, disclosed herein are trouser assemblies including a trouser assembly that may include: a trouser that may include: a circumferential waistband having an upper edge, a lower edge, a rear portion, and a front portion that may include a first end section that may include an outer surface having an outwardly facing female clasp portion and a second end section that may include a waistband flap with an inner surface having an inwardly facing male clasp portion, wherein the male clasp portion may be configured to be inserted into the female clasp portion in order to secure the waistband in a closed position; a first trouser leg with a first zipper tape extending from a first location at the lower edge of the front portion of the waistband to a second location at the lower edge of the rear portion of the waistband; a second trouser leg with a second zipper tape extending from the first location to the second location, wherein the first and second zipper tapes may be capable of being zipped from an open position to a closed position and from a closed position to an open position; and a zipper pull that may be capable of: (a) a first configuration in which the first zipper tape would be coupled to the second zipper tape when the zipper pull is in the first location at the lower end of the front portion of the waistband such that the zipper would be in a closed position; and (b) a second configuration in which the first zipper tape would be uncoupled from the second zipper tape when the zipper pull is in the second location at the lower end of the rear portion of the waistband such that the zipper would be in an open position.

Disclosed herein are trouser assemblies including a trouser assembly that may include underpants for coupling to a trouser having a crotch opening extending from a front side of the trouser to a rear side of the trouser, the underpants may include: an underpants waistband capable of being coupled to the trouser; and an underpants flap extending from a first portion of the underpants waistband, the a underpants flap may have a flap end removably coupled to a second portion of the underpants waistband, wherein the flap end may be capable of extending through the crotch opening and may be capable of being coupled to the rear side of the trouser while a person is wearing the trouser and the underpants.

Disclosed herein are trouser assemblies including a trouser assembly that may include: a trouser having a crotch opening extending from a front side to a rear side of the trouser; and underpants that may have: an underpants waistband capable of being coupled to the trouser; and an underpants flap capable of extending through the crotch opening and capable of being removably coupled to the rear side of the trouser while a person is wearing the trouser and the underpants.

Disclosed herein are trouser assemblies including a trouser assembly that may include: a trouser waistband; a right leg portion coupled to the trouser waistband; a left leg portion coupled to the trouser waistband; a trouser button coupled to an inner surface of the left leg portion, the right leg portion, or the trouser waistband; and an underpants capable of being coupled to the button, the underpants may have: an underpants waistband; and an underpants flap capable of extending between and towards a rear outer surface of either the left leg portion or the right leg portion, or both, while a person is wearing the trouser and the underpants.

Disclosed herein are trouser assemblies including a trouser assembly that may include: a trouser waistband; a right leg portion coupled to the trouser waistband; a right zipper tape coupled to the right leg portion; a left leg portion coupled to the waistband; a left zipper tape coupled to the left leg portion, wherein the left zipper tape may be capable of being removably coupled to the right zipper tape; a trouser button coupled to an inner surface of the left leg portion, the right leg portion, or the trouser waistband; and underpants that may have: an aperture receiving the trouser button therethrough; and an underpants flap capable of being disposed between the right zipper tape and the left zipper tape and coupled to an outer surface of the right leg portion, left leg portion, or the trouser waistband while a person is wearing the trouser and the underpants.

Any one of the methods or assemblies disclosed herein may further include: a right rear button coupled to a rear portion of the right leg internal surface; a left rear button coupled to a rear portion of the left leg internal surface; a right front button coupled to a front portion of the right leg internal surface; and a left front button coupled to a front portion of the left leg internal surface.

Any one of the methods or assemblies disclosed herein may further include: a left rear button coupled to an outer surface of the right leg portion; a left rear button coupled to an outer surface of the left leg portion; a first front button coupled to a front portion of the right leg internal surface; and a second front button coupled to a front portion of the left leg internal surface.

Any one of the methods or assemblies disclosed herein may further include a left external button coupled to a rear outer surface of the right leg portion; a left external button coupled to a rear outer surface of the left leg portion; a right internal button coupled to a rear portion of the right leg internal surface; and a left internal button coupled to a rear portion of the left leg internal surface.

Any one of the methods or assemblies disclosed herein may further include a coupling means capable of coupling a first portion of the trouser waistband and a second portion of the trouser waistband.

Any one of the methods or assemblies disclosed herein may further include: a pin coupled to a first portion of the trouser waistband; and a clasp coupled to a first portion of the trouser waistband, wherein the clasp and the pin may be capable of being removably coupled.

In any one of the methods or assemblies disclosed herein, the right leg portion and the left leg portion may be capable of being partially or fully separated for the front portion of the underpants to extend therebetween.

In any one of the methods or assemblies disclosed herein, the right leg portion and the left leg portion may be capable of being partially or fully separated for a flap of the underpants to extend therebetween.

In any one of the methods or assemblies disclosed herein, the front trouser button may be capable of being removably coupled to a flap of the underpants.

In any one of the methods or assemblies disclosed herein, the front trouser button may be a magnet capable of being coupled to another magnet coupled to the front portion of the underpants.

In any one of the methods or assemblies disclosed herein, the front trouser button may be a hook capable of being coupled to the front portion of the underpants.

In any one of the methods or assemblies disclosed herein, the front trouser button may be capable of being extended through the front portion of the underpants.

In any one of the methods or assemblies disclosed herein, the rear trouser button may be capable of being extended through the rear portion of the underpants.

Any one of the methods or assemblies disclosed herein may further include a rear internal trouser button coupled to the left leg internal surface, the right leg internal surface, or the internal waistband surface, wherein the rear internal trouser button may be configured for removable coupling to a rear portion of the underpants.

In any one of the methods or assemblies disclosed herein, the rear external trouser button may be capable of being removably coupled to the front portion of the underpants.

In any one of the methods or assemblies disclosed herein, the rear external trouser button may be a magnet capable of being coupled to another magnet coupled to the front portion of the underpants.

In any one of the methods or assemblies disclosed herein, the rear external trouser button may be a hook capable of being coupled to the front portion of the underpants.

In any one of the methods or assemblies disclosed herein, the rear external trouser button may be capable of being extended through the front portion of the underpants.

In any one of the methods or assemblies disclosed herein, the rear external trouser button may be capable of being extended through a flap of the underpants.

Any one of the methods or assemblies disclosed herein may further include: an inner seat surface with a first cheek surface; a second cheek surface; and first means for removably securing the first cheek surface to underpants and second means for removably securing the second cheek surface to the underpants.

Any one of the methods or assemblies disclosed herein may further include means for removably securing the waistband to the underpants.

In any one of the methods or assemblies disclosed herein, the first zipper tape and the second zipper tape may have first ends disposed below the lower edge of the rear portion of the waistband and may have second ends disposed below the lower edge of the front portion of the waistband.

In any one of the methods or assemblies disclosed herein, the first zipper tape and the second zipper tape may have first ends disposed below the lower edge of the rear portion of the waistband and may have second ends disposed below the upper edge of the front portion of the waistband, wherein the waistband flap is capable of being disposed over the second ends.

In any one of the methods or assemblies disclosed herein may further include a button coupled to the second portion of the underpants and capable of being removably coupled to the flap end.

In any one of the methods or assemblies disclosed herein, the flap end may be capable of being coupled to a trouser button disposed on the rear side of the trouser.

Any one of the methods or assemblies disclosed herein may further include a first button coupled to the flap end, wherein the first button is capable of being coupled to a second button disposed on the rear side of the trouser.

Any one of the methods or assemblies disclosed herein may further include a first magnet coupled to the flap end, wherein the magnet may be capable of being coupled to a second magnet disposed on the rear side of the trouser.

Any one of the methods or assemblies disclosed herein may further include a first button coupled to the flap end, wherein the first button may be capable of being coupled to a second button disposed on the front side of the trouser.

Any one of the methods or assemblies disclosed herein may further include an aperture disposed in the flap end, wherein the aperture may be capable of receiving a second button disposed on the front side of the trouser.

4. Specific Embodiments in the Drawings

The drawings presented herein are for illustrative purposes only and do not limit the scope of the disclosure. Rather, the drawings are intended to help enable one having ordinary skill in the art to make and use the assemblies disclosed herein.

This section addresses specific versions of trouser assemblies with zippers shown in the drawings, which relate to assemblies, elements and parts that can be part of a trouser assembly with zippers. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

FIG. 1 illustrates a perspective view of a trouser 102. In this application and any resulting patent, a "trouser" is frequently referred to synonymously as a "trouser assembly" primarily to emphasize that it is an assembly of different parts and structures including not only the zipper assembly but also the waistband. The trouser 102 has a trouser waistband 104, a right trouser leg 108, and a left trouser leg 108', each of which have inside surface(s) and outside surface(s). The trouser waistband 104 has a first waistband portion 204*a*, a second waistband portion 204*b*, and a middle waistband portion 204*c* (see FIGS. 2A-B). The "first waistband portion" refers to the portion of the waistband from the end of the waistband to the part of the waistband the inside surface of which includes the button 208*c*; the "second waistband portion" refers to the portion of the waistband from the other end of the waistband to the part of the waistband the inside surface of which includes the button 208*c'*; and the "middle waistband portion" 204*c* refers to the portion of the waistband extending from the point where one of the buttons 208*c* is coupled to the point where the other buttons 208*c'* is coupled, and includes the portion of the waistband where the inside surface of which buttons 208*d* and 208*d'* are coupled. A pin 106 is coupled, e.g., via stitching, to first waistband portion 204*a*. A clasp 106' is coupled, e.g., via stitching, to the second waistband portion 204*b*. When the pin 106 and the clasp 106' are removably coupled, i.e., to one another, the first waistband portion 204*a* and the second waist band portion 204*b* are considered to be removably coupled. Also, an end portion of the second waistband portion 204*b* is capable of overlapping an end portion of the first waistband portion 204*a*.

Additionally, the trouser waistband 104 has an upper waistband edge 110*a* and a lower waistband edge 110*b*. The lower waistband edge 110*b* may be coupled to an upper-right trouser edge 112 of the right trouser leg 108 and an upper-left trouser edge 112' of the left trouser leg 108'. The lower waistband edge 110*b* may be coupled to the upper-right trouser edge 112 and the upper-left trouser edge 112' via stitching (not shown).

The right trouser leg 108 is removably coupled to the left trouser leg 108'. The right trouser leg 108 has a right-side trouser edge 114 coupled to a left-side trouser edge 114' of the left trouser leg 108' via zipper tapes 116, 116', respectively. The right zipper tape 116 is coupled to the right-side trouser edge 114, via stitching (not shown). The left zipper tape 116' is coupled to the left-side trouser edge 114', via stitching (not shown).

Figure 2:
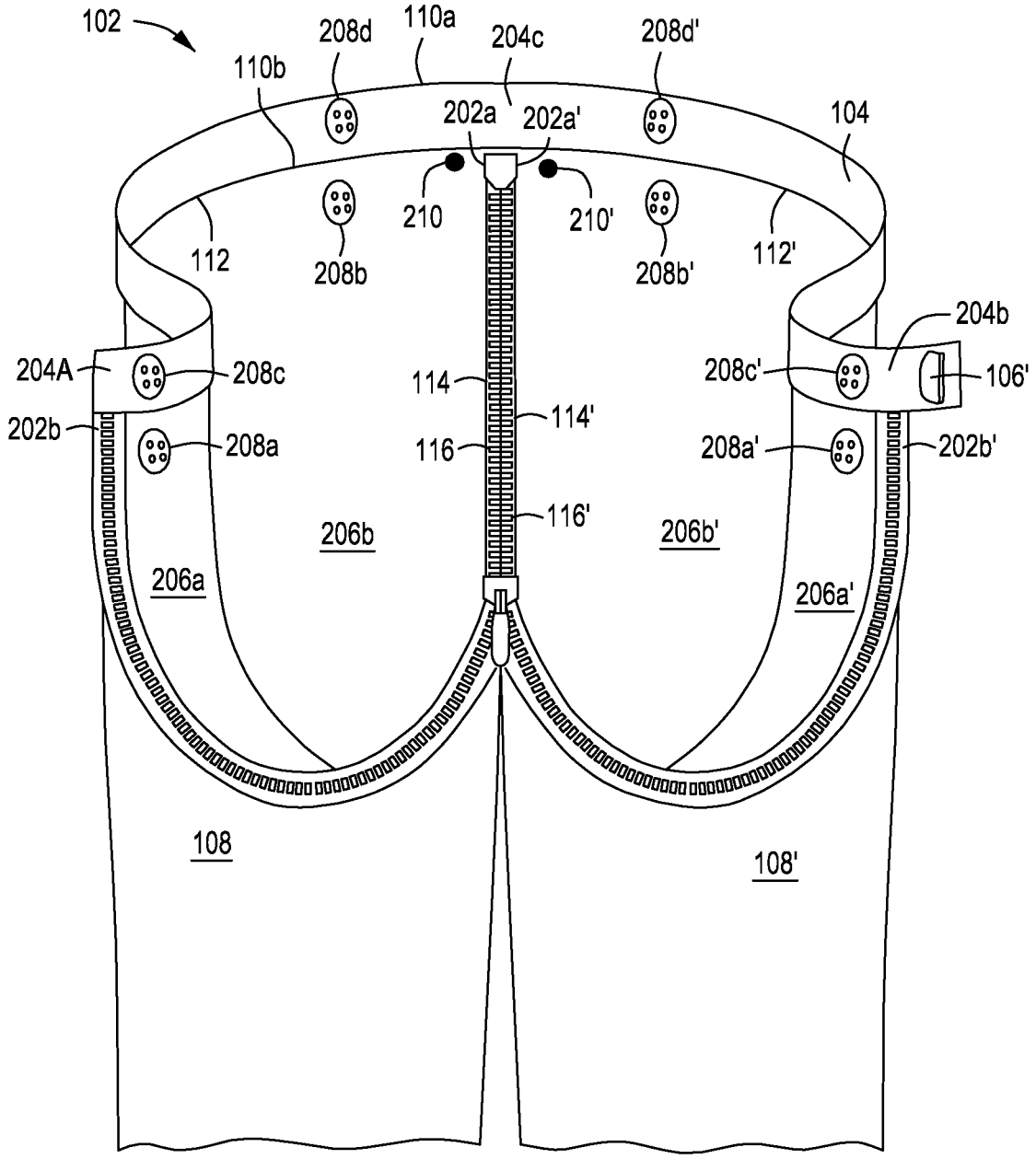
FIG. 2 illustrates a perspective front view of a trouser in an unclasped configuration with a partially open zipper.

The zipper tapes 116, 116' extend from a lower waistband edge 110*b* at a front portion of the trouser 102 to a lower waistband edge 110*b* at a rear portion of the trouser 102. Thus, the trouser 102 is capable of being fully unzipped, e.g., open, from the lower edge of the waistband at the front portion continuously to the rear portion, towards ends of the zipper tapes 116, 116', as shown in FIG. 2. However, the trouser 102 is also capable of being partially unzipped, e.g., open, anywhere between the lower edge of the waistband at the front portion and the rear portion. Accordingly, when unzipped, the right trouser leg 108 and the left trouser leg 108' may be partially or fully separated from each other.

Advantageously, as discussed below, the entire crotch area can be opened via the zipper without unclasping the front or otherwise disengaging the waistband at the front. This feature is particularly advantageous for a law enforcement officer who does not wish to remove his or her duty belt when going to the toilet; and also for a worker who does need to remove his or her tool belt when going to the toilet.

FIG. 2 illustrates a perspective view of a trouser 102 having an open front and having zipper tapes 116, 116' having ends disposed adjacent lower edges of a trouser waistband 104. The trouser 102 has a right zipper tape 116 and a left zipper tape 116' coupled, e.g., via stitching (not shown), to portions of the trouser waistband 104, a right trouser leg 108, and a left trouser leg 108'. The right zipper tape 116 is coupled to the right-side trouser edge 114. The left zipper tape 116' is coupled to the left-side trouser edge 114'.

From the lower waistband edge 110*b*, the right zipper tape 116 is coupled to a right-side trouser edge 114 of the right trouser leg 108. The right zipper tape 116 extends the length of the right-side trouser edge 114 and the width of the trouser waistband 104. Accordingly, the right zipper tape 116 has a first zipper end 202*a* adjacent a middle waistband portion 204*c* of the trouser waistband 104 and has a second zipper end 202*b* adjacent an upper edge of a first waistband portion 204*a*.

In addition, from the lower waistband edge 110*b*, the left zipper tape 116' is coupled to a left-side trouser edge 114' of the left trouser leg 108'. The left zipper tape 116' extends the length of the left-side trouser edge 114' and the width of the trouser waistband 104. Accordingly, the left zipper tape 116' has a first zipper end 202*a'* adjacent a middle waistband portion 204*c* of the trouser waistband 104 and has a second zipper end 202*b'* adjacent an upper edge of a second waistband portion 204*b*.

Referring to FIG. 2B, a trouser 102 has a right zipper tape 116 and a left zipper tape 116' coupled, e.g., via stitching (not shown), to portions of a right trouser leg 108 and a left trouser leg 108', respectively, but are not directly coupled onto a trouser waistband 104.

From adjacent the lower waistband edge 110*b*, the right zipper tape 116 is coupled to a right-side trouser edge 114 of the right trouser leg 108. The zipper tape 116 extends the length of the right-side trouser edge 114. Accordingly, the right zipper tape 116 has a first end 202*a* adjacent a middle waistband portion 204*c* of the trouser waistband 104 and a second end 202*b* adjacent a first waistband portion 204*b*.

In addition, from the lower waistband edge 110*b*, the left zipper tape 116' is coupled to a left-side trouser edge 114' of the left trouser leg 108. The zipper tape 116' extends the length of the left-side trouser edge 114'. Accordingly, the left zipper tape 116' has a first end 202*a'* adjacent a middle portion 204*c* of the trouser waistband 104 and a second end 202*b'* adjacent a second waistband portion 204*b*.

Referring to both FIG. 2A and FIG. 2B, the right trouser leg 108 has a front trouser portion 206*a* and a left trouser portion 206*b*. A front button 208*a* is coupled to an inner surface of the front trouser portion 206*a*. A rear button 208*b* is coupled to an inner surface of the rear trouser portion 206*b*.

Additionally, the left trouser leg 108' has a front trouser portion 206*a'* and rear trouser portion 206*b'*. A front button 208*a'* is coupled to an inner surface of the front trouser portion 206*a'*. A rear button 208*b'* is coupled to an inner surface of the rear trouser portion 206*b'*.

Also, buttons 208*c*, 208*c'*, 208*d*, 208*d* may be coupled to an inner surface of the trouser waistband 104. The buttons 208*c*, 208*c'* may be coupled to front portions of the trouser waistband 104. The buttons 208*d*, 208*d'* may be coupled to rear portions of the trouser waistband 104.

Furthermore, trouser magnets 210, 210' are coupled to the rear trouser portion 206*b*, 206*b'*, respectively.

Figure 3A:
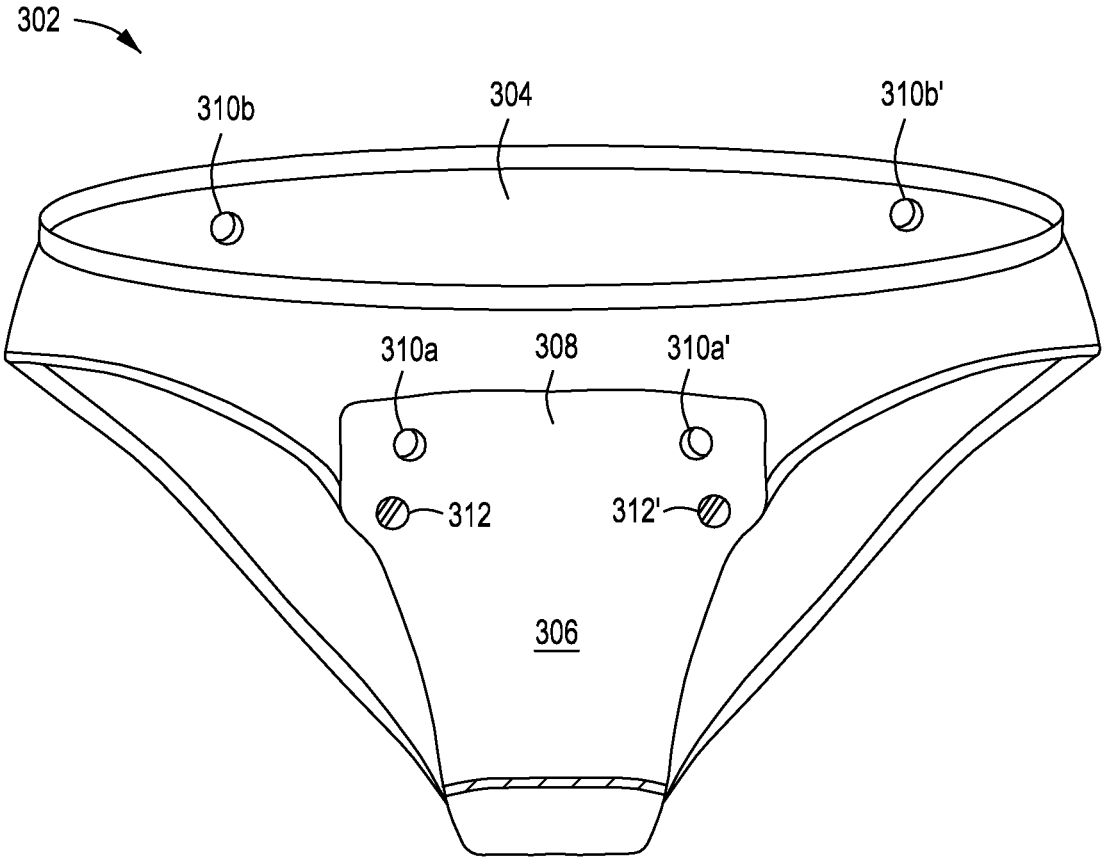
FIG. 3A illustrates a perspective front view of underpants having a front flap in an open configuration.
Figure 3B:
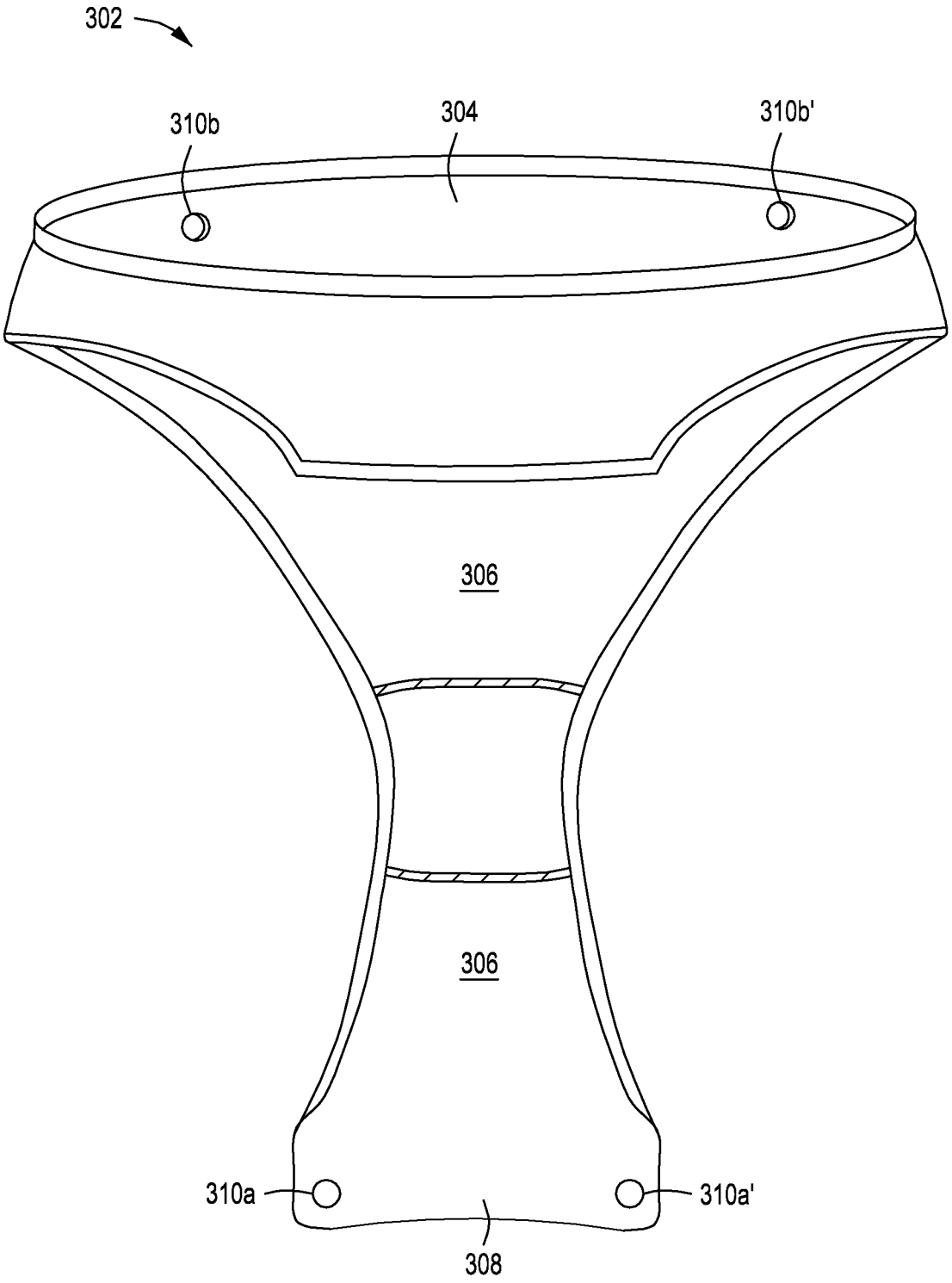
FIG. 3B illustrates a perspective front view of underpants having a front flap in a closed configuration.

FIG. 3A illustrates a perspective view of underpants 302. FIG. 3B illustrates a perspective view of underpants 302 having a flap 306 extending downward form an underpants waistband 304.

Referring to FIGS. 3A-B, underpants 302 has an underpants waistband 304 and a flap 306. The underpants waistband 304 and the flap 306 are unitary. The flap 306 extends from a rear portion of the underpants waistband 304. The flap 306 has a flap portion 308 overlapping and/or adjacent the underpants waistband 304. Flap magnets 312, 312' may be coupled, e.g., sewn and/or glued, to the flap portion 308.

The rear portion of the underpants waistband 304 has waistband apertures 310*b*, 310*b'* disposed therethrough. The flap portion 308 has flap apertures 310*a*, 310*a'* disposed therethrough.

Figure 4:
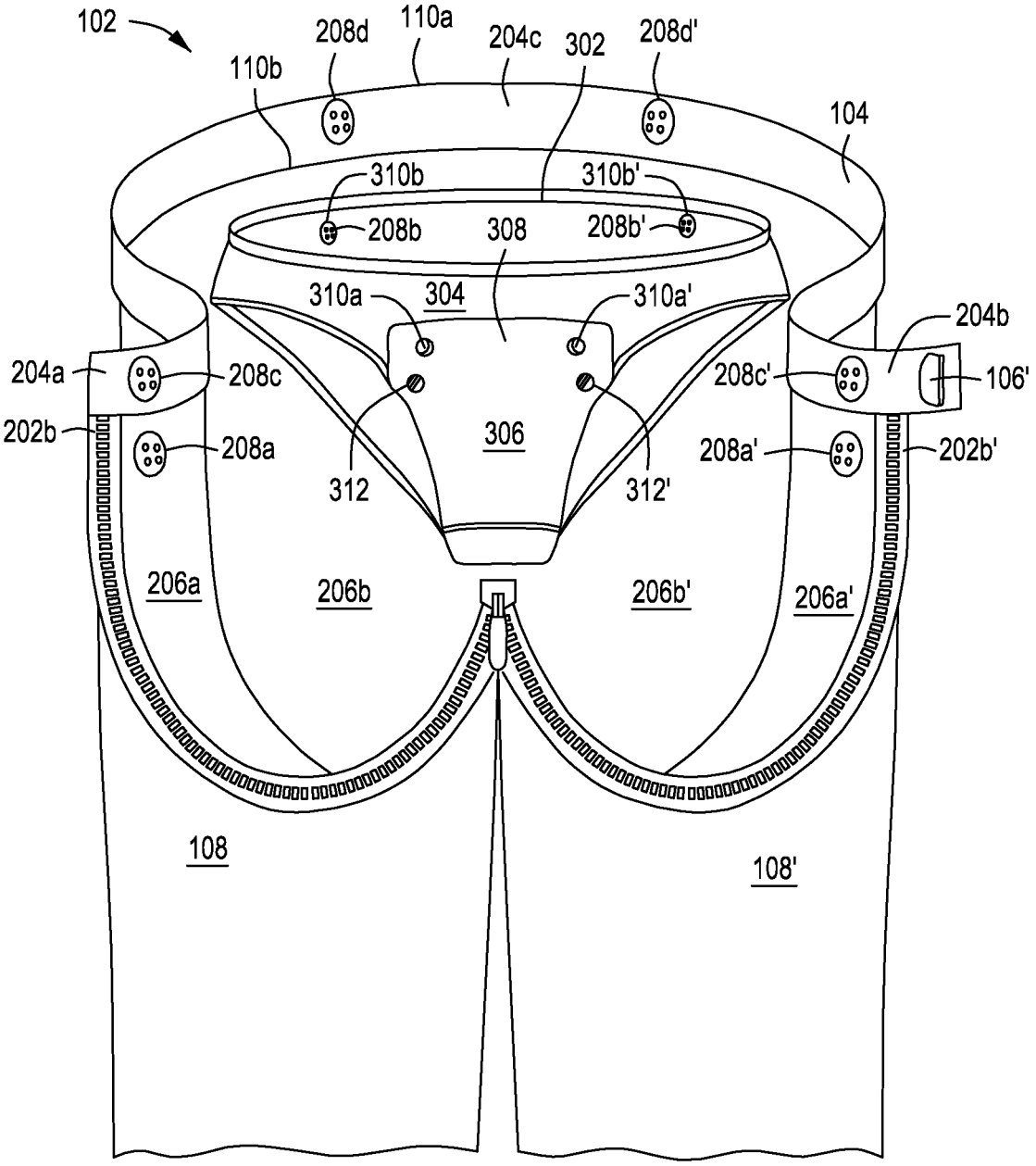
FIG. 4 illustrates a perspective front view of a trouser in an unclasped configuration with a partially open zipper and underpants coupled to the inside of the trouser.

FIG. 4 illustrates a perspective front view of a trouser 102 in an unclasped configuration with partially open zipper and underpants 302 coupled to the inside of the trouser.

FIG. 4 illustrates a perspective view of trouser assembly 100 having a trouser 102 and underpants 302 disposed in the trouser 102. The trouser 102 include trouser legs 108, 108'. The trouser legs 108, 108' have respective front trouser portions 206*a*, 206*a'* and rear trouser portions 206*b*, 206*b'*.

Front buttons 208*a*, 208*a'* are coupled, e.g., sewn, to the front trouser portions 206*a*, 206*a'*, respectively. Rear buttons 208*b*, 208*b'* are coupled, e.g., sewn, to the rear trouser portions 206*b*, 206*b'*, respectively.

A right portion of the underpants 302 is disposed between the front trouser portion 206*a* and the rear trouser portion 206*b* of the right trouser leg 108. A left portion of the underpants 302 is disposed between the front trouser portion 206*a'* and rear trouser portion 206*b'* of the left trouser leg 108'.

The underpants 302 is coupled to rear buttons 208*b*, 208*b'*. The rear buttons 208*b*, 208*b'* are inserted through underpants waistband apertures 310*b*, 310*b'*, respectively. The underpants waistband apertures 310*b*, 310*b'* extend through an underpants waistband 304 of the underpants 302. Hence, in some cases when coupled to the trouser 102 (via the rear buttons 208*b*, 208*b'*), the underpants 302 would be inhibited from falling or separating from the trouser 102.

Furthermore, the front buttons 208*a*, 208*a'* may be inserted through flap apertures 310*a*, 310*a'*. The flap apertures 310*a*, 310*a'* extend through a flap 306 of the underpants 302. Thus, in some cases when coupled to the trouser 102 (via the front buttons 208*a*, 208*a'*), the flap 306 would be inhibited from falling and/or separating from the trouser 102.

Alternatively, in some cases, the underpants 302 may be coupled to rear buttons 208*d*, 208*d'* coupled to the waistband 104. The rear buttons 208*d*, 208*d'* may be inserted through the underpants waistband apertures 310*b*, 310*b'*, respectively. Front buttons 208*c*, 208*c'* coupled to the waistband 104 may be inserted through the flap apertures 310*a*, 310*a'*. In those cases, the underpants 302 and/or the flap 306 would be inhibited from falling or separating from the trouser 102.

Figure 5A:
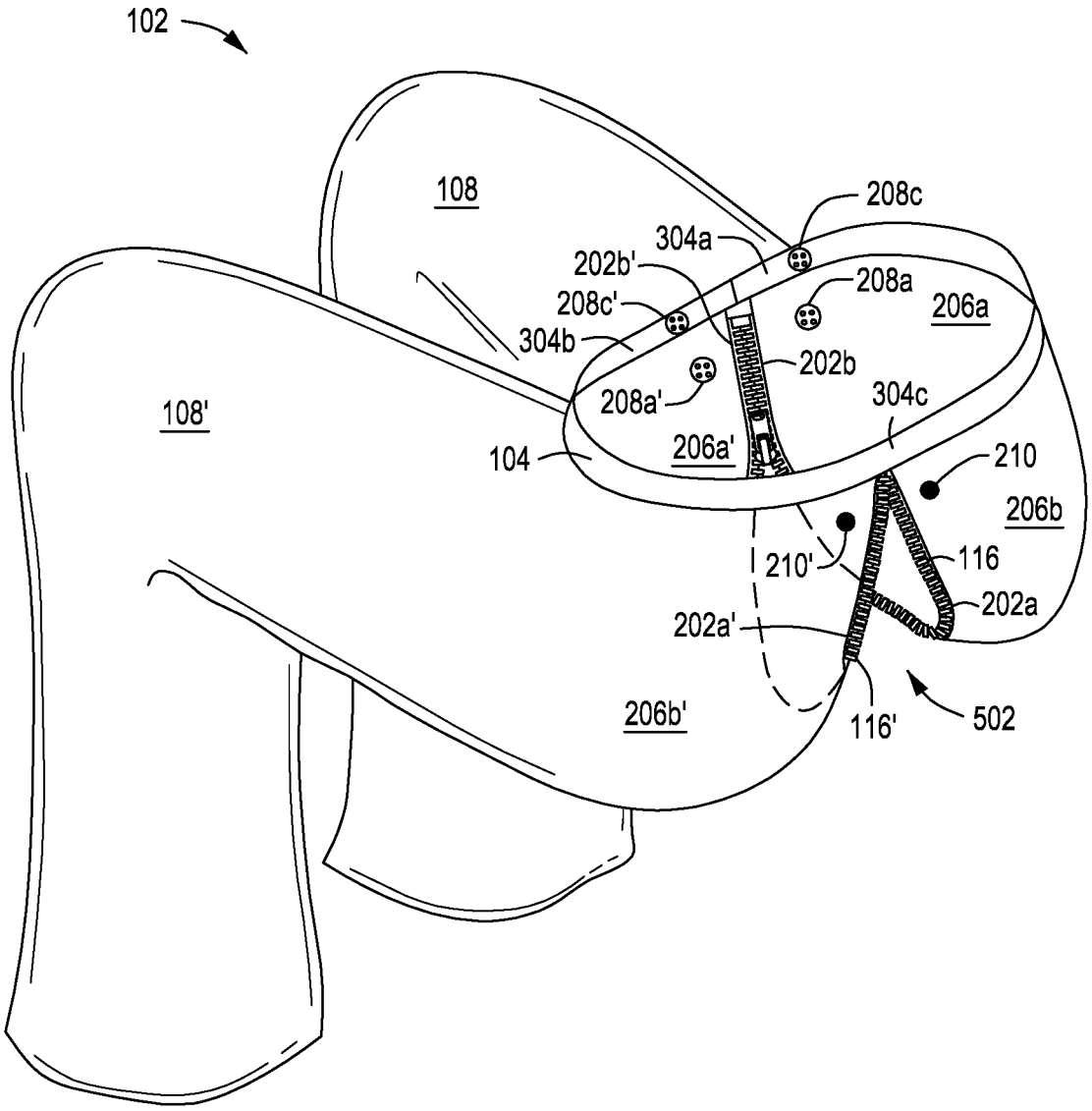
FIG. 5A illustrates a perspective rear left-side view of a trouser with a partially open zipper in a clasped and seated configuration.
Figure 5B:
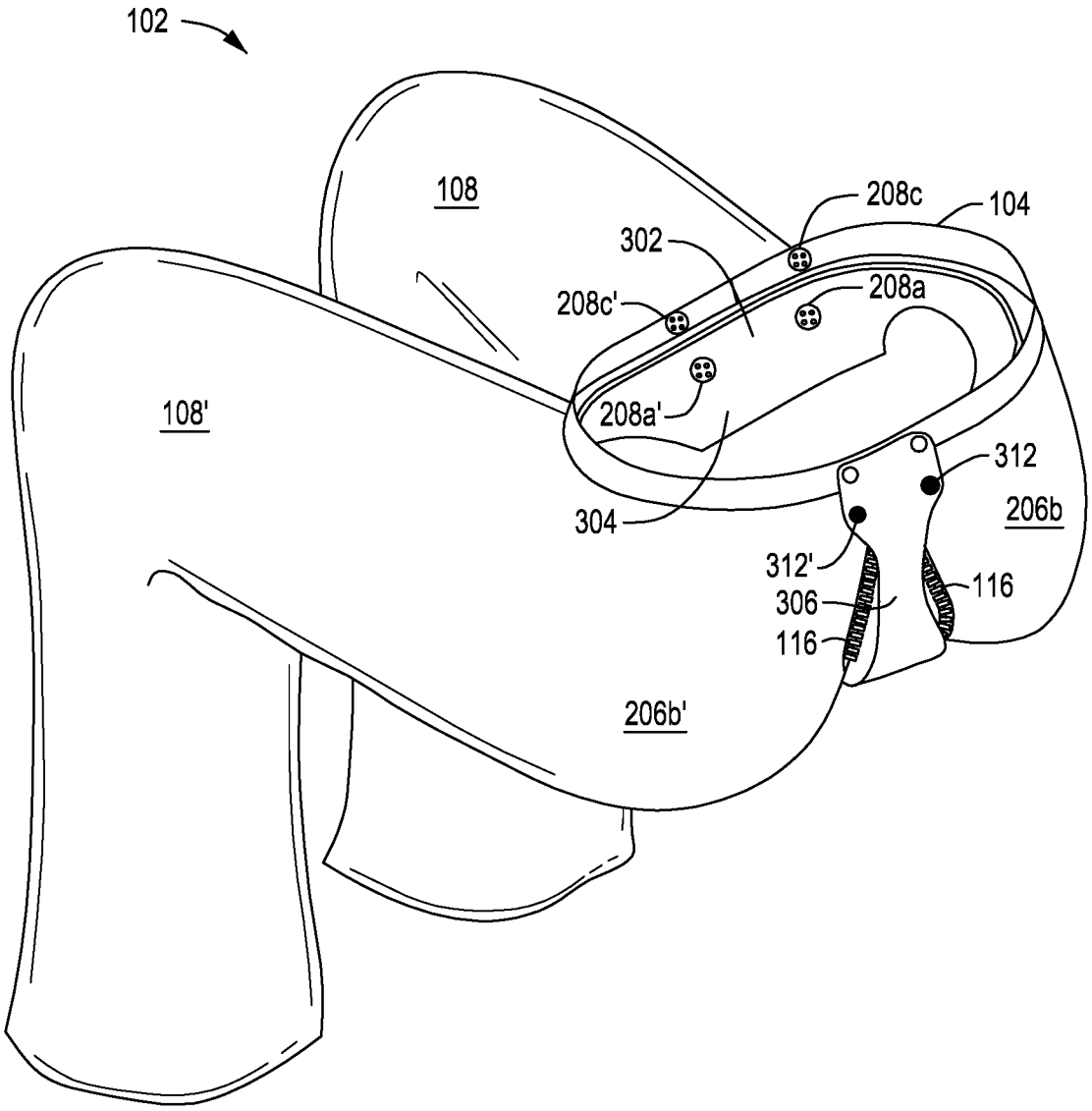
FIG. 5B illustrates a perspective rear left-side view of a trouser in a seated configuration having a flap of underpants coupled to a rear outside surface of the waistband.

FIG. 5A illustrates a perspective view of a trouser 102 in a seated configuration. FIG. 5B illustrates a perspective view of a trouser 102 in a seated configuration having a flap 306 of underpants 304 coupled to rear trouser portions 206*b*, 206*b'* of the trouser 102.

Referring to FIGS. 5A-B, a trouser 102 has a right trouser leg 108 and a left trouser leg 108' coupled, e.g., via stitching (not shown), to portions of a trouser waistband 104. The right trouser leg 108 and the left trouser leg 108' have respective rear trouser portions 206*b*, 206*b*'. The rear trouser portions 206*b*, 206*b*' have respective trouser magnets 210, 210' coupled thereto.

Additionally, the trouser 102 has a right zipper tape 116 and a left zipper tape 116' are coupled, e.g., via stitching (not shown), to portions the right trouser leg 108 and the left trouser leg 108'. The right zipper tape 116 has a first end 202*a* adjacent a middle waistband portion 204*c* of the trouser waistband 104 and a second end 202*b* adjacent a first waistband portion 204*a* of the waistband 104. The left zipper tape 116' has a first end 202*a*' adjacent a middle waistband portion 204*c* of the trouser waistband 104 and a second end 202*b*' adjacent a second waistband portion 204*b* of the trouser waistband 104.

In the seated configuration, the right zipper tape 116' and the left zipper tape 116' may be partial uncoupled or fully uncoupled from each other (see FIG. 2 and FIG. 4). As shown in FIGS. 5A-B, when the trouser 102 is in the seated configuration and the zipper tapes 116, 116' are uncoupled, the portions of the right trouser leg 108 and the left trouser leg 108', adjacent the respective zipper tapes 116, 116', would be separated. The separated trouser leg portions would expose a crotch opening 502 in the trouser 102.

Referring to FIG. 5B, underpants 304 disposed in the trouser 102 has a flap 306 extending through the crotch opening 502. Moreover, the flap 306 is pulled towards the rear trouser portions 206*b*, 206*b*' of the trouser 102. The flap 306 includes flap magnets 312, 312' coupled to the trouser magnets 210, 210'. Thus, in some cases when the flap magnets 312, 312' are coupled to the trouser magnets 210, 210', the flap 306 would be inhibited from falling and/or separating from the trouser 102.

Benefits of trouser assemblies 100 disclosed herein and exemplified in FIGS. 1-5 include the ability to maintain a trouser 102 in a pulled-up configuration while using the toilet, e.g., so that the sides, rear and at least a portion of the front of a trouser waistband 104 remains around a wearer's waist, while using the toilet. That ability is particularly advantageous for individuals who wear belts that are not necessarily connected to the trouser, e.g., passing through belt loops. For example, the trouser assembly 100 is particularly beneficial to law enforcement officers who wear duty belts that hold firearms, tasers, handcuffs, etc., and for construction workers who wear utility belts holding tools and other equipment. Such persons may wear a trouser assembly 100 and have expedient restroom relief without having to remove the trouser assembly 100 or lower it to a pulled-down configuration. As an example, while wearing the duty or utility belt, the person may need to use the restroom. In most cases when wearing standard trousers, the person would need to remove the heavy-duty belt or utility belt, which may be very cumbersome. In public restrooms, if a bathroom stall does not have a hook, the person might need to place the duty or utility belt on the floor, which is not only unsanitary but also dangerous in the case of law enforcement officers. None of those steps are required with the trouser assemblies 100 disclosed herein.

In certain embodiments, the trouser 102 may include zipper tapes 116, 116' that terminate at a lower edge 110*b* of the waistband 104 in the rear, and also in the front. In those embodiments, when the zipper tapes 116, 116' terminate at respective lower edges of waistband portions 204*a*, 204*b*, a zipper pull can be located at or just below that lower edge 110*b*, so that it is easily accessible even with the duty belt or utility belt being worn. Advantageously, disposing the zipper pull below the first waistband portion 204*a* and the second waistband portion 204*b* facilitates easy grasping, e.g., via the person's thumb and index finger, of the zipper pull if the person were to wear the duty or utility belt over the waistband 104. Additionally, a pin 106 and a clasp 106', coupling the waistband portions 204*a*, 204*b*, would not necessarily obstruct access to the zipper pull and might not even need to be unclasped.

Thus, referring to FIGS. 1-5, a person may wear a trouser 102 over underpants 302 of a trouser assembly 100 and have expedient restroom relief without having to remove the trouser 102 or lower it to a pulled-down configuration. The underpants 302 has an underpants waistband 304 coupled to rear buttons 208*b*, 208*b*' coupled to the trouser 102 (see FIG. 4). The underpants 302 has a flap 306 coupled to front buttons 208*a*, 208*a*' coupled to the trouser 102. Advantageously, in cases when coupled to the buttons 208*a*', 208*a*', 208*b*, 208', the underpants 302 may be inhibited from shifting inside the trouser 102 or sliding down the person's hip or legs.

Alternatively, the person may couple the underpants 302 to a trouser waistband 104 of the trouser 102. Rear buttons 208*d*, 208*d*' may be inserted through the underpants waistband 304. Front buttons 208*c*, 208*c*' may be inserted through the flap 306. Thus, the underpants 302 may be inhibited from shifting inside the trouser 102 or sliding down the person's hip or legs as well.

To use a toilet while wearing the trouser assembly 100, the person may unzip zipper tapes 116, 116'. The zipper tapes 116, 116' are coupled to a front portion of a right trouser leg 108 and a front portion of a left trouser leg 108' of the trouser 102, respectively. Respective second zipper ends 202*b*, 202*b*' of the zipper tapes 116, 116' may be coupled to the right trouser leg 108 and the left trouser leg 108' adjacent a lower edge 110*b* of the trouser waistband 104. The second zipper end 202*b* of the zipper tape 116 may be disposed below a lower edge of a second waistband portion 204*a*. The second zipper end 202*b*' of the zipper tape 116' may be below a lower edge of a second waistband portion 204*b*. A zipper pull may be coupled to second zipper ends 202*b*, 202*b*' (below the waistband) to hold them together.

Starting below the first waistband portion 204*a* and the second waistband portion 204*b*, the person may pull the zipper pull to unzip the zipper tapes 116, 116'. The person may pull the zipper pull towards a middle waistband portion 204*c* of the trouser waistband 104. The person may unzip the zipper tapes 116, 116' until their respective second zipper ends 202*b*, 202*b*' are separated (see FIG. 2 and FIG. 4). The person may uncouple a pin 106 (coupled to the first waistband portion 204*a*) and clasp 106' (coupled to the second waistband portion 204*b*). The unzipped zipper tapes 116, 116' may expose a crotch opening 502 in the trouser 102.

Next, the person may uncouple the flap 306 from the front buttons 208*a*, 208*a*'. The person may pull the flap 306 through the crotch opening 502 towards rear portions 206*b*, 206*b*' of the trouser 102. The person may couple flap magnets 312, 312' disposed on the flap 306 to respective trousers magnets 210, 210' on the rear portions 206*b*, 206*b*', respectively.

Afterwards, the person may sit on the toilet, setting the trouser assembly in a seated configuration. In some cases when the flap magnets 312, 312' are coupled to the trouser magnets 210, 210', the flap 306 would be inhibited from falling and/or separating from the trouser 102. Moreover, the flap 306 would not obstruct the person's use of the toilet while sitting.

After using the toilet, the person may reverse the steps discussed above to close the crotch opening 502.

What is claimed as the invention is:

1. A trouser in combination with underpants, wherein the trouser comprises:

a front trouser side and a rear trouser side;

a trouser waistband having a front portion with a lower edge and a rear portion with a lower edge and further having an internal waistband surface;

a right leg portion coupled to the trouser waistband and having a right leg internal surface;

a left leg portion coupled to the trouser waistband and the right leg portion and having a left leg internal surface;

a right zipper tape coupled to the right leg portion, wherein the right zipper tape extends from the lower edge of the front portion of the trouser waistband to the lower edge of the rear portion of the trouser waistband;

a left zipper tape coupled to the left leg portion and coupled to the right zipper tape, wherein the left zipper tape extends from the lower edge of the front portion of the trouser waistband to the lower edge of the rear portion of the trouser waistband;

at least one rear trouser coupling means coupled to one or more of the left leg internal surface, the right leg internal surface, or the internal waistband surface; and at least one front trouser coupling means coupled to one or more of the left leg internal surface, the right leg internal surface, or the internal waistband surface; and the underpants comprises:

a rear underpants portion with a rear underpants coupling means coupled to the at least one rear trouser coupling means;

a front underpants portion; and a flap with a flap coupling means that (a) when in a closed position is coupled to the at least one front trouser coupling means and (b) when in an open position is coupled to the rear trouser portion.

2. The trouser in combination with underpants of claim 1, further comprising:

a right rear button coupled to a rear portion of the right leg internal surface;

a left rear button coupled to a rear portion of the left leg internal surface;

a right front button coupled to a front portion of the right leg internal surface; and a left front button coupled to a front portion of the left leg internal surface.

3. The trouser in combination with underpants of claim 1, further comprising:

a left rear button coupled to an outer surface of the right leg portion;

a left rear button coupled to an outer surface of the left leg portion;

a first front button coupled to a front portion of the right leg internal surface; and a second front button coupled to a front portion of the left leg internal surface.

4. The trouser in combination with underpants of claim 1, further comprising:

a left external button coupled to a rear outer surface of the right leg portion;

a left external button coupled to a rear outer surface of the left leg portion;

a right internal button coupled to a rear portion of the right leg internal surface; and a left internal button coupled to a rear portion of the left leg internal surface.

5. The trouser in combination with underpants of claim 1, further comprising a coupling means capable of coupling a first portion of the trouser waistband and a second portion of the trouser waistband.

6. The trouser in combination with underpants of claim 1, further comprising:

a pin coupled to a first portion of the trouser waistband; and a clasp coupled to a first portion of the trouser waistband, wherein the clasp and the pin are capable of being removably coupled.

7. The trouser in combination with underpants of claim 1, wherein the right leg portion and the left leg portion are capable of being partially or fully separated for the front portion of the underpants to extend therebetween.

8. The trouser in combination with underpants of claim 1, wherein the right leg portion and the left leg portion are capable of being partially or fully separated for a flap of the underpants to extend therebetween.

9. The trouser in combination with underpants of claim 1, wherein the front trouser coupling means is capable of being removably coupled to a flap of the underpants.

10. The trouser in combination with underpants of claim 1, wherein the at least one front trouser coupling means is a magnet capable of being coupled to another magnet coupled to the front portion of the underpants.

11. The trouser in combination with underpants of claim 1, wherein the at least one front trouser coupling means is a hook capable of being coupled to the front portion of the underpants.

12. The trouser in combination with underpants of claim 1, the at least one front trouser coupling means is capable of being extended through the front portion of the underpants.

13. The trouser in combination with underpants of claim 1, the at least one rear trouser coupling means is capable of being extended through the rear portion of the underpants.

14. A trouser in combination with underpants, wherein the trouser comprises:

a front trouser side and rear trouser side;

a circumferential waistband having an upper edge, a lower edge, a rear portion, and a front portion that includes a first end section that includes an outer surface having an outwardly facing female clasp portion and a second end section that includes a waistband flap with an inner surface having an inwardly facing male clasp portion, wherein the male clasp portion is configured to be inserted into the female clasp portion in order to secure the waistband in a closed position;

a first trouser leg with a first zipper tape extending from a front portion of the first trouser leg to the rear portion of the waistband;

a second trouser leg with a second zipper tape extending from a front portion of the second trouser leg to the rear portion of the waistband, wherein the first and second zipper tapes are capable of being zipped from an open position to a closed position and from a closed position to an open position; and a zipper pull that is capable of:

(a) a first configuration in which the first zipper tape is coupled to the second zipper tape when the zipper pull is in the first location at the lower end of the front portion of the waistband such that the zipper is in a closed position; and (b) a second configuration in which the first zipper tape is uncoupled from the second zipper tape when the zipper pull is in the second location at the lower end of the rear portion of the waistband such that the zipper is in an open position;

a first rear trouser coupling means coupled to the first trouser leg;

a first front trouser coupling means coupled to the first trouser leg;

a second rear trouser coupling means coupled to the second trouser leg;

a second front trouser coupling means coupled to the second trouser leg; and the underpants comprises:

a rear underpants portion with a rear underpants coupling means coupled to the first front coupling means or the second front coupling means, or both;

a front underpants portion; and a flap with a flap coupling means that (a) when in a closed position is coupled to either the first front trouser coupling means or the second front trouser coupling means, or both, and (b) when in an open position is coupled to the rear trouser portion.

15. The trouser in combination with underpants of claim 14, further comprising:

an inner seat surface with a first cheek surface;

a second cheek surface; and first means for removably securing the first cheek surface to underpants and second means for removably securing the second cheek surface to the underpants.

16. The trouser in combination with underpants of claim 14, further comprising means for removably securing the waistband to the underpants.

17. The trouser in combination with underpants of claim 14, where the first zipper tape and the second zipper tape have first ends disposed below the lower edge of the rear portion of the waistband and have second ends disposed below the lower edge of the front portion of the waistband.

18. The trouser in combination with underpants of claim 14, wherein the first zipper tape and the second zipper tape have first ends disposed below the lower edge of the rear portion of the waistband and have second ends disposed below the upper edge of the front portion of the waistband, wherein the waistband flap is capable of being disposed over the second ends.

19. The trouser in combination with underpants of claim 1, wherein the flap is capable of being extended through the rear trouser side.

20. The trouser in combination with underpants of claim 14, wherein the flap is capable of being extended through the rear trouser side.

* * * * *